US006044598A

United States Patent [19]

Elsasser et al.

[11] Patent Number: 6,044,598

[45] **Date of Patent: *Apr. 4, 2000**

[54] ELONGATED MEMBER OF EXTRUDED PLASTIC SUITABLE FOR FLOORING, DECKING, SEATING, AND LIKE USES

[75] Inventors: Glenn R. Elsasser; Frederic E. C. Wall, both of Winnipeg, Canada

[73] Assignee: Western Profiles Limited, Manitoba, Canada

[ * ] Notice: This patent is subject to a terminal disclaimer.

[21] Appl. No.: 09/174,450

[22] Filed: Oct. 19, 1998

Related U.S. Application Data

[63] Continuation-in-part of application No. 08/769,670, Dec. 19, 1996, Pat. No. 5,826,382.

[51] Int. Cl.[7] ..... E04F 11/16

[52] U.S. Cl. ..... 52/181; 52/177; 52/182; 52/188; 52/8

[58] Field of Search ..... 52/177, 181, 182, 52/188, 191, 8

[56] References Cited

U.S. PATENT DOCUMENTS

| | | |
|---|---|---|
| 4,840,824 | 6/1989 | Davis . |
| 4,998,391 | 3/1991 | Connew . |
| 5,009,045 | 4/1991 | Yoder . |
| 5,048,448 | 9/1991 | Yoder . |
| 5,070,664 | 12/1991 | Groh et al. . |
| 5,613,339 | 3/1997 | Pollock . |
| 5,647,184 | 7/1997 | Davis . |
| 5,758,467 | 6/1998 | Snear et al. . |
| 5,826,382 | 10/1998 | Elsasser et al. ..... 52/181 |

FOREIGN PATENT DOCUMENTS

| | | |
|---|---|---|
| 989134 | 5/1976 | Canada . |
| 1190717 | 7/1985 | Canada . |
| 2100986 | 1/1995 | Canada . |
| 2108425 | 4/1995 | Canada . |

*Primary Examiner*—Carl D. Friedman
*Assistant Examiner*—Yvonne M. Horton
*Attorney, Agent, or Firm*—Jones, Tullar & Cooper, P.C.

[57] ABSTRACT

An elongated member suitable for flooring, decking, or seating, having a top plate formed as an extrusion of plastic material suitable for overlying a support, wherein the top plate includes ribs constituted by protruding parts of parallel, spaced apart, elongated friction elements co-extruded therewith, the friction elements being formed of plastic having distinctly greater softness or flexibility than the main parts of the top plate and suitable for providing a non-slip surface. The member may include an elongated support formed as a relatively rigid extrusion of plastic material having a base plate with upstanding side walls and a longitudinally extending upstanding support portion positioned between the walls, the top plate overlying the support and having edge formations engaging the side walls. The top plate and support may be formed integrally by extrusion.

22 Claims, 4 Drawing Sheets

ELONGATED MEMBER OF EXTRUDED PLASTIC SUITABLE FOR FLOORING, DECKING, SEATING, AND LIKE USES

CROSS-REFERENCE TO RELATED APPLICATION

This application is a continuation-in-part of U.S. Ser. No. 08/769,670, filed Dec. 19, 1996, now issued as U.S. Pat. No. 5,826,382, dated Oct. 27, 1998.

BACKGROUND OF THE INVENTION

1. Field of the Invention

The present invention relates to an elongated member made entirely or partially of extruded plastic, and suitable for the upper surface of decks, docks, or bench type seating, and for other uses, generally in walking, standing, or sitting areas.

2. Prior Art

There have been various prior proposals for using plastic extrusions for decking and like flooring needs, especially for outdoor use, for example as described in the following patents:

Canadian Patent No. 989,134, issued May 18, 1976 to Hassman;

Canadian Patent No. 1,190,717, issued Jul. 23, 1985, to Stanley et al.;

Canadian Patent Application No. 2,100,986, published Jan. 22, 1995, of Steadman; and Canadian Patent Application No. 2,108,425, published Apr. 15, 1995, of Bayly.

Also, U.S. Pat. No. 5,070,664, which issued Dec. 10, 1991 to Groh. et al., describes an extruded plastic structure for fitting onto wooden or steel benches to improve comfort and weather resistance.

The Canadian patents of Hassman and Stanley et al., and the Steadman application, describe structures formed of polyester resin or like material with glass fiber reinforcement, these structures being formed by pultrusion. The Bayly application describes a plastic channel type member, which seemingly might be extruded, although this does not appear to be mentioned.

A common drawback of plastic surfaces for decks and other walking areas is that these tend to be slippery, especially when wet. Some of these prior patents show ribs or other formations intended to provide a non-slip surface. Thus the structure shown in the Hassman patent has ribs on its upper surface, integrally formed of the same reinforced plastic material, and intended to prevent slipping. The Stanley et al. patent describes a non-skid feature provided by a grit surface applied to the upper face of the member during the pultrusion process. The Bayly application states that its flooring members can have textured surfaces so they will not be slippery when wet, although the nature of these surfaces is not given. The Groh et al. patent shows a structure with an overlying cap or "capstock" of between 15 and 25 mils in thickness, formed of a rigid vinyl resin, intended to improve weatherability, and which also has spaced apart, integrally formed, parallel ridges which provide a gripping surface.

These prior art non-skid features are believed to have some drawbacks. Thus, ribs of the type shown in the Hassman or Groh et al. patents provide little gripping effect in directions parallel to the ribs. In each case, the ribs are formed integrally with the surrounding material and thus have the same hardness or firmness. The actual decking made in accordance with the Groh et al. patent, including the ribs, has a hard surface and lacks friction in the direction of the ribs; tests discussed below give a comparison of the friction achieved with Groh et al. compared to material made in accordance with this invention. Surfaces of the kind described in the Stanley et al patent, or in the Bayly application, are likely to be difficult to produce as part of an extrusion process. There exists a need for a flooring member which can easily be produced by extrusion, and which has a non-skid feature which is effective lengthwise of the member and not only in the cross direction.

SUMMARY OF THE INVENTION

The present invention overcomes these drawbacks by providing an elongated member suitable for flooring, decking, or seating, comprising top plate means overlying a support and bridging gaps between parts of the support, both the top plate means and the support being formed by extrusion of plastic material, wherein the top plate means has a non-slip surface provided by ribs constituted by portions of parallel, spaced apart, elongated friction elements co-extruded with a main component of the top plate, these elements being formed from plastic material having distinctly greater softness or flexibility than that of the main component which lies between and underneath the elements. These elements have their lower portions embedded in the top plate means. However since the top plate means must resist bending, the elements are made so as not to penetrate more than one half the top plate depth, and preferably penetrate only 35% or 25% of the top plate depth.

The ribs in accordance with this invention have a hardness between 50 and 92 Durometer in the Shore A scale. The softness of the ribs in accordance with this invention is comparable to that of treads on shoes, and gives the ribs enhanced friction in the longitudinal direction, as well as in the transverse direction.

Preferably, the ribs protrude from the top plate between 0.02 and 0.05 inches (0.5 to 0.13 mm). The ribs may be integral with a capstock layer which forms part of the top plate means and totally covers the main component.

A preferred embodiment of the invention is an all plastic, all extruded, elongated member, for example a hollow flooring member, comprising a top plate means as described overlying a lower support part also formed as an extrusion of plastic material and having a base plate with upstanding side walls and upstanding, longitudinally extending support webs positioned between the side walls, the top plate means bridging gaps between the side walls and webs.

The top plate means may be formed separately from the support part, and may have inturned edge elements held by interengaging formations at the top of the side walls of the support part.

Alternatively, the top plate means may be formed integrally with the support portion, the webs and side walls of the support part being integral with the top plate means.

BRIEF DESCRIPTION OF THE DRAWINGS

Preferred embodiments of the invention will now be described by way of example with reference to the accompanying drawings, in which.

DETAILED DESCRIPTION

Figure 1:
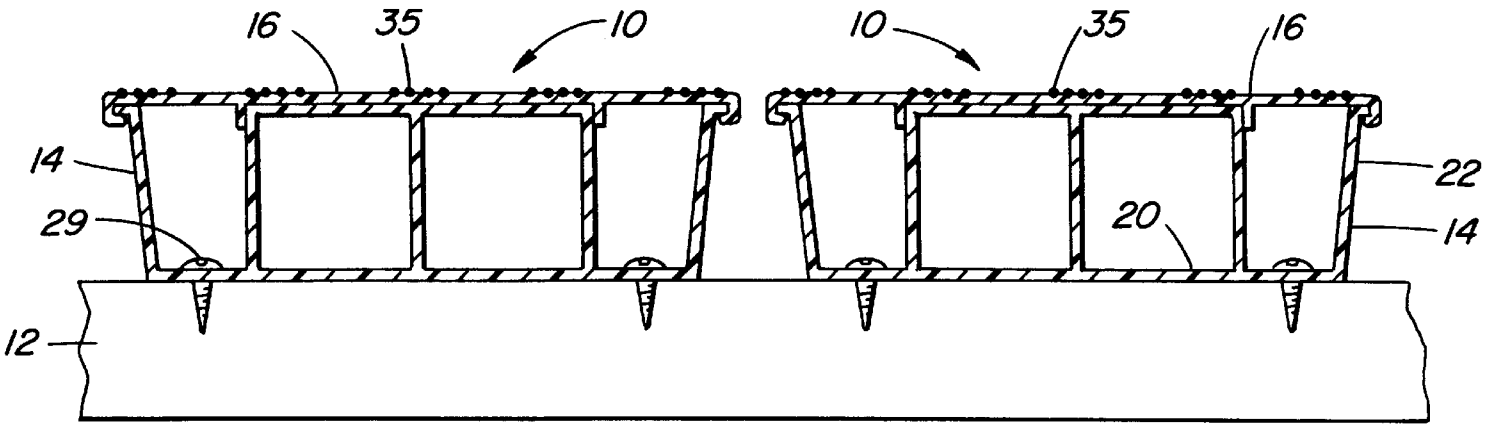
FIG. 1 is a cross-sectional view through a portion of a deck using flooring members according to this invention.

In FIG. 1 two elongated members 10 in accordance with this invention are shown supported on a wooden joist 12. Each member is made of two parts, shown separately in FIGS. 4 and 5. These parts include a support part 14, shown in FIG. 5, and a top plate part 16 shown in FIG. 4. Each of these parts is integrally formed by extrusion, and the whole of the support part, and most of the top plate, are formed of rigid PVC (polyvinyl chloride). The width of each part is between 5 and 6 inches, and the wall thickness of each is about 0.1 inches or 2.5 mm.

It will be seen that the support part 14 has a base plate 20 with upstanding side walls 22, and that upper edges of the walls have outwardly projecting lips 22*a*. A central region of the support part has an upstanding support portion 24 extending longitudinally of the member, this having a height almost the same as that of the walls. The support portion has two outer upstanding support webs 26 and a central upstanding support web 27, these webs being bridged by a roof member 28, providing an upper support surface.

The base plate 20 is fastened to the joists 12 by screws 29 which penetrate the base plate and which are accessible between the walls 22 and the outer webs 26. Afterwards, the top plate 16 is applied.

Figure 4:
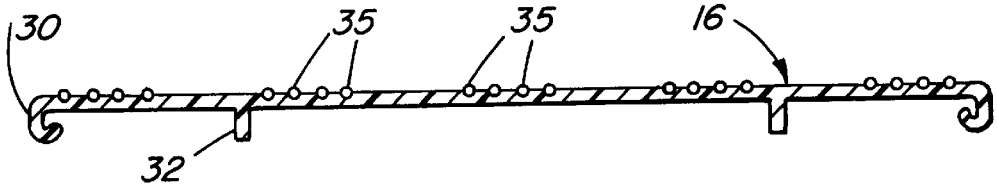
FIGS. 4 and 5 are enlarged sectional views of the main components of the flooring member.
Figure 5:
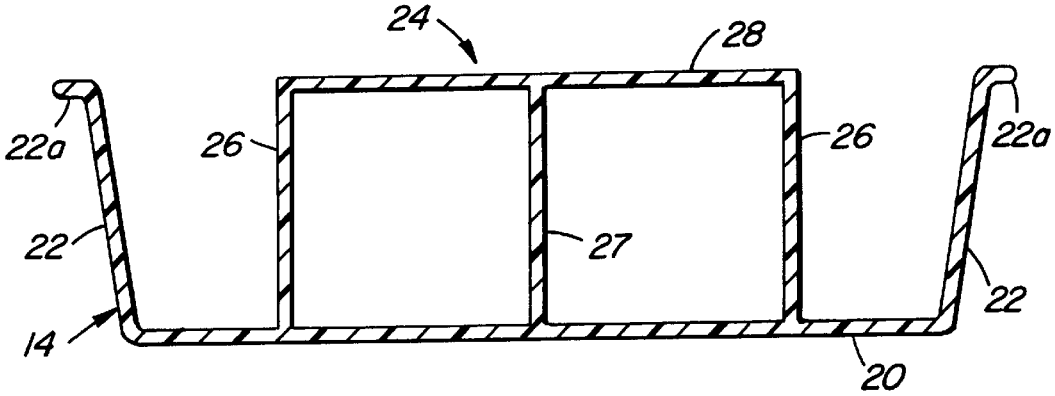

The top plate part, shown in FIG. 4, is generally flat, except for inturned side edge elements 30 providing inwards facing grooves shaped to be a snap fit onto the lips 22*a* of the side walls 22 of the support part, and depending ribs 32 which locate against the upper margins of the webs 26. The top plate and support part can be snap fitted together, without any holding means being required, the top plate being removable by use of a suitable tool. Although the top plate is formed of similar rigid PVC as the support part, since it is largely flat it is capable of being bent longitudinally, and can be supplied in roll form; alternatively it can be supplied in pre-cut lengths. The top plate needs to be made of a plastic composition which is highly resistant to weathering.

In accordance with this invention, the top plate 16 is provided with ribs constituted by upper portions of rod-like parallel elongated friction elements 35 which protrude from the upper surface of the main component of the top plate, having their lower portions embedded in this main component, the main component lying between and underneath these elements. These friction elements have a roughly circular cross-section of between 0.04 and 0.10 inches diameter, and about half the cross-section of each of these elements, usually about 0.02 to 0.05 inches, protrudes above the generally flat upper surface of the top plate to provide a non-skid surface. Each top plate has five groups of these friction elements, each group comprising four such elements spaced between 0.1 and 0.15 inches apart. Elements 35 are also formed of plastic, and are co-extruded with the main component of the top plate. These elements 35 are however of flexible PVC; i.e. they are formed of PVC having considerably more plasticiser than that of the Prigid PVC which forms the main component of the top plate and which is normally exposed between these elements, and have distinctly greater flexibility. In practice, the hardness of the flexible plastic forming the friction elements 35 will be between 50 and 92 Durometer hardness on the Shore A scale, and preferably between 55 and 90, and most preferably between 75 and 85 on this scale. By comparison, the rigid PVC of the remainder of the top plate has a hardness of between 70 and 90 on the Shore D scale. Measurements of 54 or more on the D scale all relate to hardnesses greater than 95 on the A scale. These figures are for instantaneous hardness as tested according to ASTM D2240. The flexible PVC is similar to material used to produce treads of shoe soles, and has sufficient friction that it has a non-skid effect in the longitudinal direction of the flooring member, as well as in the transverse direction.

Figure 3:
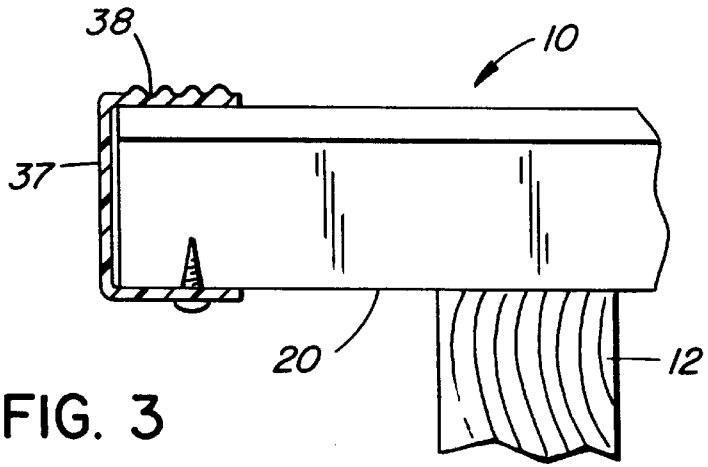
FIG. 3 is a partial longitudinal section of the end of a member.
Figure 2:
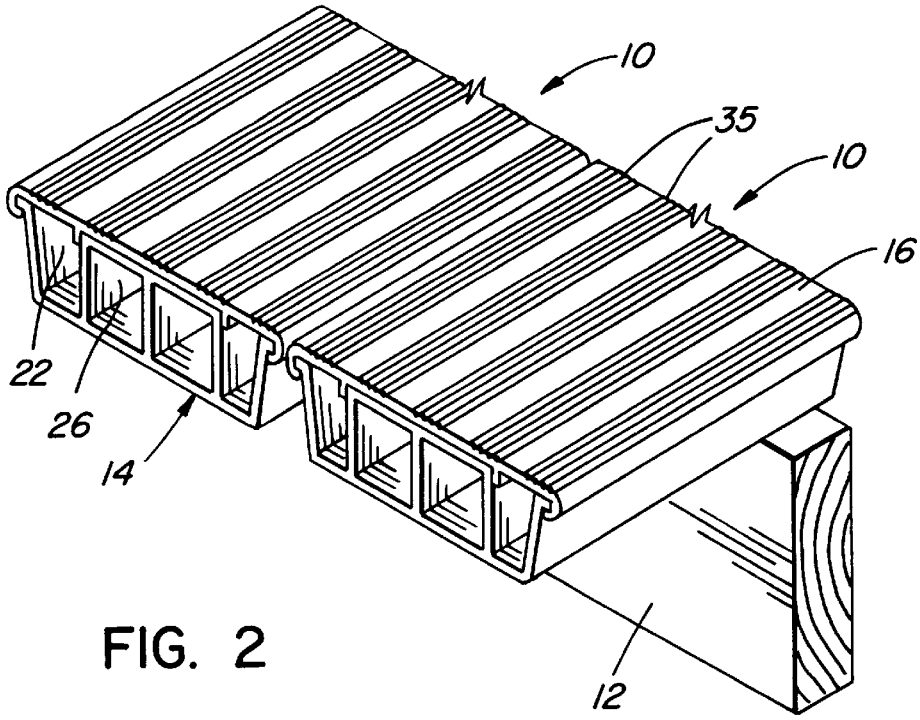
FIG. 2 is a perspective view of the ends of the two members.

After the supports described have been fixed to the joists 12 and assembled with their top plates, the ends are closed by channel members 37 shown in FIG. 3. These channel members, which are also of extruded plastic material, have upper and lower flanges which enclose the upper and lower margins of the ends of the flooring members. The lower flanges are fastened to the base plate 20 by screws. The upper flanges 38 have small longitudinal ribs which also provide a non-skid feature.

Tests have been done to show that the product made in accordance with this invention exhibits substantially more friction than the prior art Groh et al. type product made in accordance with U.S. Pat. No. 5,070,664. The results of these tests are shown on the Tables 1 and 2 set out below. These tests were carried out by the Industrial Technology Centre, of Niakwa Road East, Winnipeg, Manitoba, Canada; this is an agency of the Government of Manitoba, Dept. of Industry, Trade and Tourism. The tests were conducted using the ASTM C1028 test method of the American Society for Testing and Materials, entitled:

"Standard test Method for Determining the Static Coefficient of Friction of Ceramic Tile and Other Like Surfaces by the Horizontal Dynamometer Pull-Meter Method".

The procedure for the tests involves the use of a heel assembly of suitable material, such as "Neolite" rubber, which is loaded with a 50 pound (22 Kg) weight and pulled along a flooring surface being tested. The static friction is determined by measuring the pull needed to move the heel assembly with a horizontal pull meter, and is done at mutually perpendicular angles, and in both wet and dry conditions. To obtain the coefficient of friction (COF), the average pull force for each condition is divided by the weight being used plus the weight of the heel assembly, and a calibration factor is added. In the tests done on Applicant's "Trac-decking" product, and the Groh. et al. type product shown in the Tables as "Grey decking", two series of tests were done, the first (Table 1) with rubber, and a second (Table 2) with leather. The results are as follows:

TABLE 1

Coefficient of Friction Test (Rubber)

| SAMPLE DESCRIPTION | TEST DIRECTION | TEST NO. | | RUBBER DRY | RUBBER WET |
|---|---|---|---|---|---|
| "TRAC-DECKING" | Parallel | 1 | Pull | 45.5 | 43.0 |
| | | 2 | Force | 45.5 | 47.0 |
| | Perpendicular | 1 | in lbs. | 46.5 | 55.0 |
| | | 2 | | 45.0 | 58.0 |
| | | COF | | 0.79 | 0.93 |
| GREY DECKING | Parallel | 1 | Pull | 34.0 | 39.0 |
| | | 2 | force | 31.0 | 38.5 |
| | Perpendicular | 1 | in lbs. | 41.5 | 41.0 |
| | | 2 | | 39.5 | 42.0 |
| | | COF | | 0.61 | 0.72 |

TABLE 2

Coefficient of Friction Test (Leather)

| SAMPLE DESCRIPTION | TEST DESCRIPTION | TEST NO. | | LEATHER DRY | LEATHER WET |
|---|---|---|---|---|---|
| "TRAC-DECKING" | Parallel | 1 | Pull | 39.0 | 40.0 |
| | | 2 | Force | 34.5 | 40.0 |
| | Perpendicular | 1 | in | 38.5 | 42.5 |
| | | 2 | lbs. | 36.5 | 42.5 |
| | | COF | | 1.06 | 0.73 |
| GREY DECKING | Parallel | 1 | Force | 15.0 | 30.0 |
| | | 2 | in | 11.5 | 28.0 |
| | Perpendicular | 1 | lbs. | 16.5 | 37.5 |
| | | 2 | | 15.0 | 38.0 |
| | | COF | | 0.62 | 0.58 |

Tables 1 and 2 show that the coefficient of friction for Applicants' product, when used with rubber (Table 1), is 0.79 and when dry and 0.93 when wet. The comparable friction coefficients for the Groh et al. type product ("Grey decking") are 0.61 and 0.72. While this is a useful increase in friction, more pronounced differences are noted with leather, as shown in Table 2. Here, the coefficients obtained with the Applicants' "Trac-decking", dry and wet, are 1.06 and 0.73 respectively, while the coefficients obtained for the "Grey decking" are 0.62 and 0.58, dry and wet respectively. It will further be noted from Table 2 that the results for the "parallel" direction, i.e. along the ribs, was very low for the dry "Grey decking", considerably less than one half that achieved with the "Trac-decking". The very low friction of the "Grey decking" shown here would be slippery to anyone walking in leather shoes on this kind of decking. Also, Table 2 shows that even in the case of the dry "perpendicular" pull with the "Grey decking", the coefficient of friction, while higher than in the "parallel" direction, is always less than one half the minimum friction achieved in any of the tests with Applicant's "Trac-decking". These tests indicate that Applicants' "Trac-decking" is considerably less slippery than a typical prior art decking of extruded plastic material.

Variations are of course possible in the particular dimensions and material to be used. The elongated friction elements 35 may be of different cross-sectional size and shape, for example they may be square or diamond shape in cross-section. What is important is that a proportion of these elements projects above the surface of the top plate by at least 0.02 inches (0.5 mm), and amounts of projection up to 0.05 inches (1.3 mm) may be used. In order not unduly to weaken the top plate where it bridges the gaps between the side flange 22 and the bridge part 24, the friction elements will not penetrate into this more than one half its depth, so that at least 0.05 inches (1.3 mm) of top plate remains below the ribs. It is not necessary that PVC be used for the top plate and/or friction elements, and the same effect can for example be achieved with ABS plastics, using a small proportion of plasticiser in the main part of the member and more in the elements 35 so that these are of flexible ABS plastic. It is also possible to form the top plate so that it has a thin capstock, of say 0.004 to 0.010 inch thickness, of weatherable plastic having good color uniformity, overlying a base layer of cheaper recycled material. A further variation of the capstock is described below.

Figure 6:
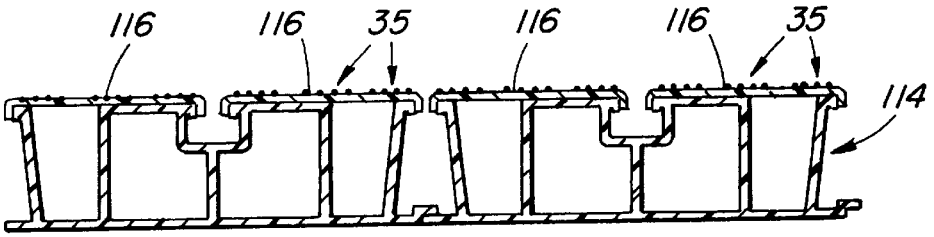
FIG. 6 is a cross-sectional view of another embodiment of the invention.
Figure 7:
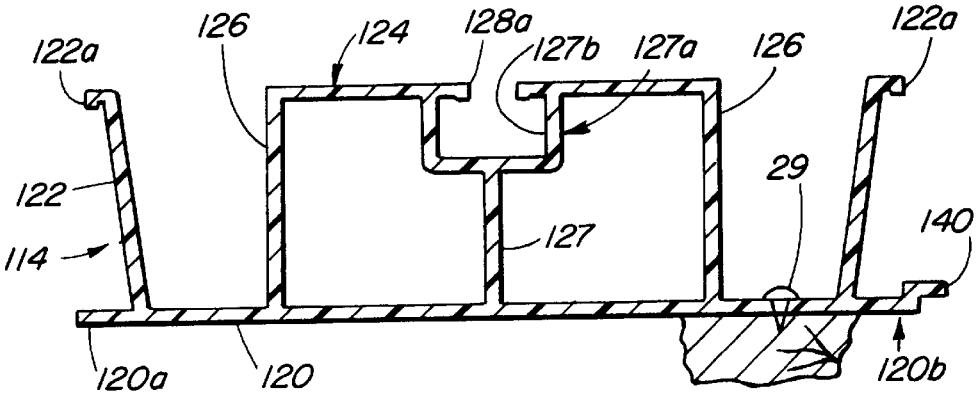
FIG. 7 is a detail cross-section of the support part of the FIG. 6 embodiment.

FIGS. 6 and 7 shows a variation of the decking member which has top plate means comprising a pair of narrow side-by-side top plates, and in which the support part has two support portions which support inner sides of the top plates.

Specifically, the support part 114, which is shown in detail in FIG. 7, has upstanding side walls 122 sloping upwardly and outwardly from near the side edges of the base plate 120, and has two upstanding support portions 124 extending longitudinally between the side walls and having inner edges spaced on opposite sides of a centerline of the support part. Each support part has an outer support web 126, a central web 127, and a channel formation 127*a* supported by web 127, the flanges 127*b* of which in turn support inner portions of roof parts 128. These parts 128 have inner edges 128*a* projecting inwardly beyond the flanges 127*b*.

As in the first embodiment, the base plate 120 is fastened to an underlying support by screws 29 or other fasteners inserted between the side walls 122 and the support webs 126, before the top plates are fitted. Installation is facilitated by another feature of this design, namely the presence of side extensions 120*a*, 120*b*, which project beyond the lower edges of the side walls 122 and provide means for accurately locating the support parts. The extension 120*b* has a raised lip formation 140 which, in conjunction with an underlying surface such as a joist, provides a recess capable of receiving an edge of side extension 120*a* of an adjacent identical member.

As seen in FIG. 6, the outer lips 122*a* of the side walls 122 and the projecting inner edges 128*a* of the roof parts provide formations which interengage with inturned side edge elements of the top plates 116, which can be snapped into place after the support parts have been installed. Each top plate has three groups of friction elements 35 which are identical or similar to those of the first embodiment. It will be noted that, as before, the top plates bridge the gaps between the side walls 122 and the support portions, and as before the friction elements are arranged not to unduly weaken the top plates.

The design of FIGS. 6 and 7 is easier to install than that of FIGS. 1–5, since the top plates are more flexible. Also, the narrower top plates, which are less than 3 inches in width, are often preferred for their appearance over the wider plates of the earlier embodiment. The engagement of the side edges of adjacent support parts, which is given by the formations 120*a* and 120*b*, makes for easy accurate installation, especially where the installers are non-professionals. Furthermore, the mating edge formations make the decking substantially waterproof, which is a feature desired by many customers.

Figure 8:
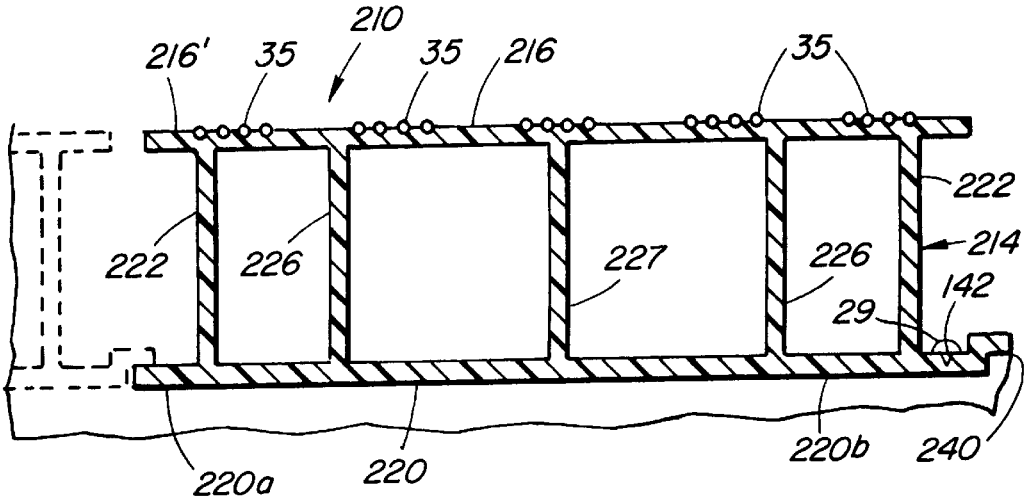
FIG. 8 is a cross-sectional view through a third embodiment of the invention.

FIG. 8 shows a further embodiment of the invention which is integrally extruded from plastics material as a single hollow member, instead of being formed of several parts.

The member 210 of FIG. 8 has a lower support part 214 comprising a flat base plate 220 with upstanding, substantially vertical side walls 222, between which are located upstanding, substantially vertical support webs 226 and 227, at locations corresponding to those of webs 26 and 27 of the first embodiment. Here, the walls and webs are integral with the top plate part 216. As in the first embodiment, the top plate has ribs formed by protruding portions of parallel spaced apart friction elements 35, which are formed of plastic having distinctly greater softness or flexibility than the main component of the top plate. The softness of these elements, and the hardness of the surrounding main component of the top plate, are similar to those of the first embodiment.

In this embodiment the top plate provides the only bridge part between the webs 226 and 227, and accordingly the top plate is significantly stressed in bending and it is important that the friction elements are arranged so as not to unduly weaken the top plate. Preferably, they occupy less than 50% of the thickness of the top plate, and most preferably less than 35% or 25% the thickness of the top plate. Since the top plate needs more strength than in previous embodiments, the thickness of this is preferably at least 0.12 inches or 3 mm, and the friction elements are arranged so that the top plate plastic under the elements is at least 0.07 inches (1.8 mm) in depth, and preferably at least 0.08 or 0.09 inches (2 mm or 2.3 mm) in depth.

The base plate 220 has side extensions 220*a*, 220*b*, which project beyond the lower edges of the side walls 222. These are similar to those shown in FIG. 7 and also assist in locating the members accurately side-by-side. Here, however, they serve an additional purpose, namely in providing convenient means for securing the member to a supporting joist. One of the extensions 120*b* has a groove 142 which provides a location for screws 29 used to fasten the member to a joist. The outer edge of the same extension 220*b* has a raised lip formation 240 which operates, as in FIG. 7, to provide a recess capable of receiving an edge of side extension 220*a* of an adjacent identical member.

The top plate part 216 and lower support part 214 may be coextruded of different materials, with sun and weather resistant material being used for the top plate part and cheaper material being used in the support part.

Figure 9:
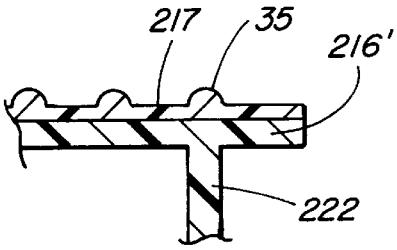
FIG. 9 is a cross-sectional view through a portion of the top plate part of the embodiment of FIG. 8, but with a modified form of friction elements.

FIG. 9 shows a fragmentary portion of the top plate of FIG. 8 which has been modified to include a capstock 217 integral with the ribs 35 and coextruded with the main component 216'. The capstock is of the same relatively soft material as the ribs, this material being chosen so that, although soft, it is wear resistant. This arrangement provides a construction in which the ribs, while embedded in the top plate (which includes the capstock layer), do not weaken the main component 216'.

Figure 10:
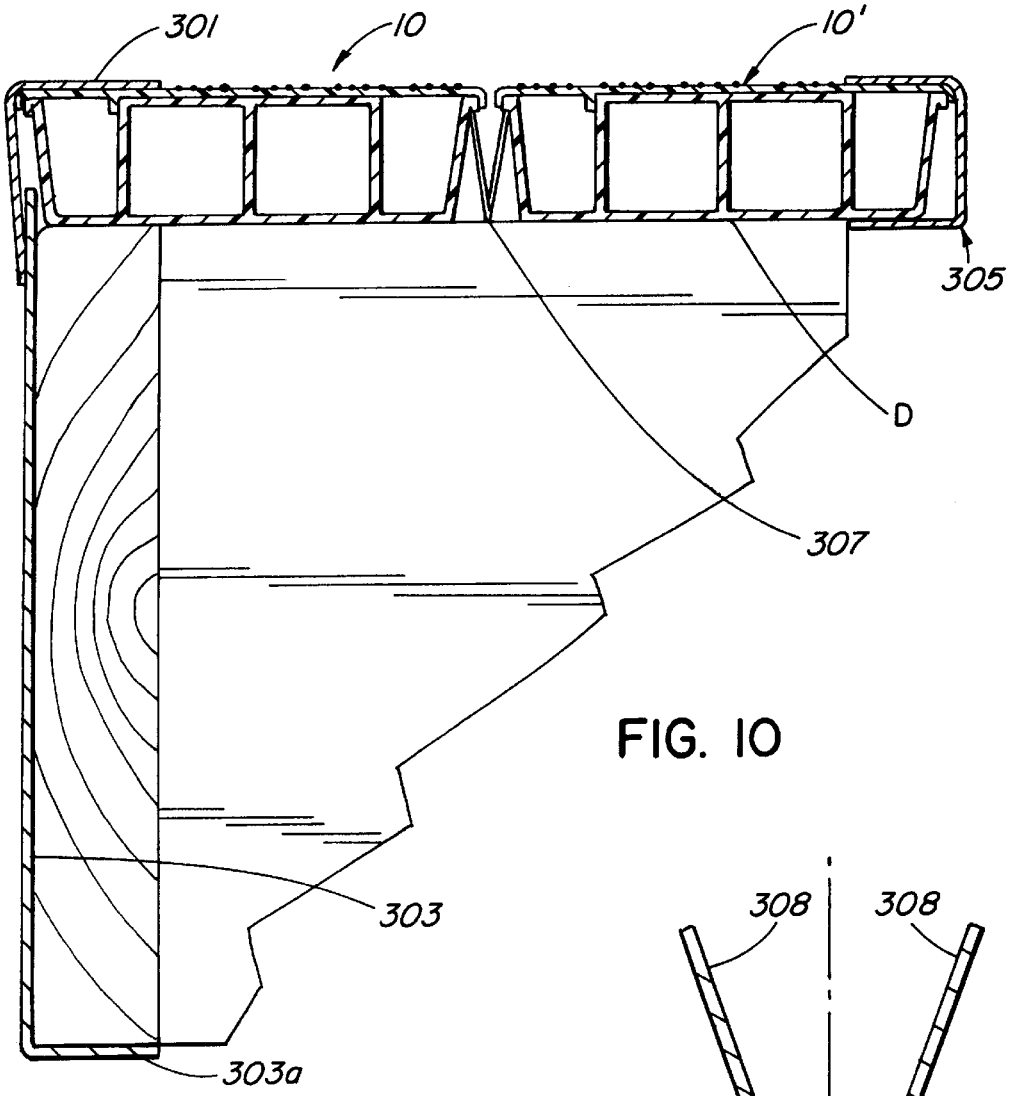
FIG. 10 is a cross-sectional view of decking incorporating the flooring members of FIGS. 1–5, and with an additional component.

FIG. 10 shows the edge portion of a decking with a top surface D carrying two elongated members 10 and 10' of the type shown in FIGS. 1 to 5. FIG. 10 shows additional components, namely:

at the outer edge, an end finish L angle member 301 covering the outer portion of the outermost top plate and having a depending flange;

a deck skirting member 303 with an upper edge fitted underneath the depending flange of the member 301, and having a lower horizontal flange 303*a;* an end finish C channel 305 fitted to the inside edge of member 10', and which is somewhat similar to part 37 shown in FIG. 3.

Figure 11:
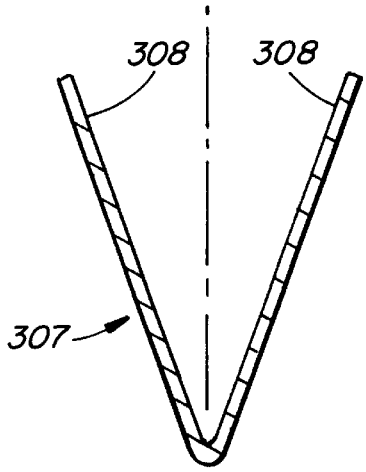
FIG. 11 is a cross-sectional view of one additional component.

In addition, FIG. 10 shows, between the members 10 and 10', a deck drain part 307, shown enlarged in FIG. 11. This is an extruded plastic member of V form, having two flanges joined at the bottom, the upper edges 308 of the two flanges being fitted under protruding upper edge portions of the adjacent elongated members. In the case of the members 10 and 10', these protruding upper edge portions are the inturned side edge elements 30 of the top plates of members 10 and 10'. However, it will be appreciated that if the part were to be used with the integrally formed members 210, the protruding upper edge portions would be the protruding edges 216' of the top plate 216. The bottom of the drain part rests on the decking D between the members 10 and 10'. This drain part is effective to drain rainwater from the deck, largely preventing the water from reaching the deck. It is particularly useful where a deck needs to be prevented from leaking rainwater onto a lower patio or similar area.

We claim:

1. An elongated member suitable for flooring, decking, or seating, and formed from plastics material by extrusion, comprising top plate means overlying a lower support and bridging gaps between parts of the support, both the top plate means and support being extruded;

wherein said top plate means includes a main component and, protruding therefrom, ribs constituted by portions of parallel, spaced apart, elongated friction elements co-extruded with said main component, said friction elements being formed of plastic having distinctly greater softness or flexibility than that of said main component which lies between and underneath said friction elements, said friction elements having a hardness of between 50 and 92 Durometer on the Shore A scale and being suitable for providing a non-slip surface;

and wherein said friction elements have their lower portions embedded in the top plate means and are such as not to penetrate more than one half the top plate depth.

2. An elongated member according to claim 1, wherein the friction elements are such as not to penetrate more than 35% of the top plate depth.

3. An elongated member according to claim 1, wherein the friction elements have a hardness of between 75 and 85 Durometer on the Shore A scale.

4. An elongated member according to claim 1, wherein said main component of the top plate means has a hardness of at least 70 Durometer on the Shore D scale.

5. An elongated member according to claim 1, wherein said friction elements are rods.

6. An elongated member according to claim 1, wherein said lower support has an upstanding support portion extending longitudinally between two upstanding side walls, and wherein said top plate means is formed separately from the lower support and has intumed side edge elements, said side edge elements and said upstanding side walls having interengaging formations, said top plate means bridging gaps between the side walls and the support portion.

7. An elongated member according to claim 1, wherein said lower support has two support portions extending longitudinally between two upstanding side walls and spaced apart on opposite sides of a centerline of the elongated member, and wherein said top plate means includes a pair of side-by-side top plates each having an outer edge element engageable with one of said upstanding side walls and an inner edge element engageable with an inner side of a support portion.

8. A decking system comprising a plurality of elongated, extruded plastic members according to claim 6 arranged side-by-side, each member having protruding edge portions at both of their sides, said members being interconnected by a drainage part having a generally V form in cross-section with upstanding flanges dimensioned to fit underneath protruding edge portions of adjacent elongated members.

9. An elongated member according to claim 1, wherein the top plate means and said support are formed as an integral hollow extrusion.

10. A hollow elongated member accord to claim 9 wherein said support includes a base plate, and sidewalls and webs integrally formed with and extending upwardly from the base plate, and wherein said base plate has side extensions which project beyond said side walls and which include recess means for receipt of fasteners.

11. A hollow elongated member according to claim 10, wherein one of said side extensions includes a formation for receiving and retaining the side extension of an identical adjacent elongated member.

12. A hollow elongated member according to claim 9, wherein the friction elements have a hardness of between 75 and 85 Durometer on the Shore A scale.

13. An elongated member according to claim 1, wherein said friction elements are integral with a capstock layer overlying said main component of the top plate means.

14. A decking system comprising a plurality of elongated members according to claim 1, in which adjacent members are interconnected by a drainage part, said drainage part having a generally V form in cross-section with upstanding flanges dimensioned to fit underneath protruding edge portions of adjacent elongated members.

15. An elongated hollow member suitable for flooring, decking, or seating, and formed from plastics material by extrusion, comprising:

a lower support having a base plate and upstanding side walls and two upstanding support portions extending longitudinally between said side walls, said support portions being spaced on opposite sides of a centerline of the elongated member;

a pair of side-by-side top plates each having an outer edge element engageable with one of said upstanding side walls and an inner edge element engageable with an inner edge of one of said support portions, wherein said top plates each include a main component and, protruding therefrom, ribs constituted by portions of parallel, spaced apart, elongated friction elements co-extruded with said main component, said friction elements being formed a plastic having distinctly greater softness or flexibility than that of said main component which lies between and underneath said friction elements, and wherein said friction elements having a hardness of less than 92 Durometer on the Shore A scale and are suitable for providing a non-slip surface.

16. A hollow elongated member according to claim 13, wherein the friction elements have a hardness of between 75 and 85 Durometer on the Shore A scale.

17. A hollow elongated member according to claim 15, wherein said support includes side extensions of said base plate which project beyond said side walls, one of said extension having means for locating a complementary side extension of an adjacent identical member.

18. A hollow elongated member according to claim 15, wherein said friction elements have their lower portions embedded in the top plates and are such as not to penetrate more than one half the depth of the top plates.

19. A hollow elongated member according to claim 15, wherein said friction elements have their lower portions embedded in the top plate means and are such as not to penetrate more than 35% the depth of the top plate means.

20. A hollow elongated member according to claim 15, wherein said friction elements have their lower portions embedded in the top plate means and are such as not to penetrate more than 25% the depth of the top plate means.

21. A hollow elongated member according to claim 15, wherein said friction elements have their lower portions embedded in the top plate means and are such that a thickness of top plate of at least 0.07 inches (1.8 mm) lies under the ribs.

22. A hollow elongated member according to claim 15, wherein said friction elements have their lower portions embedded in the top plate means and are such that a thickness of top plate of at least 0.09 inches (2.3 mm) lies under the ribs.

* * * * *